United States Patent [19]

Bish et al.

[11] 4,240,491

[45] Dec. 23, 1980

[54] THIN-FILM WINDOW FOR NUCLEAR INSTRUMENTS AND METHOD OF MAKING SAME

[75] Inventors: Ralph E. Bish, Freeport; Arata Suzuki, Pittsburgh, both of Pa.

[73] Assignee: Capintec Inc., Montvale, N.J.

[21] Appl. No.: 915,574

[22] Filed: Jun. 14, 1978

Related U.S. Application Data

[63] Continuation of Ser. No. 718,674, Aug. 30, 1976, abandoned.

[51] Int. Cl.[2] ..... E06B 3/30; E06B 9/24

[52] U.S. Cl. ..... 160/380

[58] Field of Search ..... 160/378, 380

[56] References Cited

U.S. PATENT DOCUMENTS

| | | | |
|---|---|---|---|
| 2,343,037 | 2/1944 | Adelman | 160/380 |
| 2,906,327 | 9/1959 | Crumley et al. | 160/380 |
| 3,243,042 | 3/1966 | Moulton | 160/380 |

FOREIGN PATENT DOCUMENTS

| | | | |
|---|---|---|---|
| 204568 | 11/1907 | Fed. Rep. of Germany | 160/380 |

*Primary Examiner*—Peter M. Caun

*Attorney, Agent, or Firm*—Fleit & Jacobson

[57] ABSTRACT

A thin-film window for a nuclear instrument comprising a frame ring, a thin film tightly stretched about the frame ring, a clamp ring for securing the thin film about the frame ring in a tightly stretched condition, and securing means such as a weld or glue, for securing the clamp ring to the frame ring. The thin-film window is manufactured by first preparing the frame ring and clamp ring by cleaning and removing stresses on the rings, cooling the frame ring to a temperature below that of the clamp ring, stretching a thin-film over the frame ring, clamping the clamp ring over the thin-film and frame ring while the film is stretched thereover, maintaining the clamp ring over the frame ring until they are at the same temperature, removing the excess film along the outside edges of the rings, and securing the rings together.

6 Claims, 3 Drawing Figures

10
11
12
20
21
22
33
32
13
14
31
30
23
17
6
16
8
9
15
1
3
2
7
19
5
18
4

THIN-FILM WINDOW FOR NUCLEAR INSTRUMENTS AND METHOD OF MAKING SAME

This is a continuation of Ser. No. 718,674, filed Aug. 30, 1976, now abandoned.

BACKGROUND AND SUMMARY OF THE INVENTION

Thin-film windows are often required for a detector or probe for a nuclear instrument. Such thin-film windows are used in parallel plate ionization chambers to form one of the plates and also as a window through which x-rays pass through. In such use, it is desirable to have the window of a thin material to minimize attenuation of the x-rays. It is also desirable for the chamber to have a flat response for low-energies, such as those used in mammography. Thus, it is an object of this invention to provide a thin-film window for use in ionization chambers of a material that will minimize attenuation of x-rays and have a flat response at low-energy levels.

In parallel plate ionization chambers, the available space is usually limited. It is thus an object of this invention that the frame holding the window be as small as possible to minimize x-ray scattering from the frame into the sensitive volume between the parallel plates. The frame must however be able to maintain a taut uniform stretching of the thin-film window.

Thin-filmed windows used in nuclear instruments are frequently subjected to severe temperature and pressure changes which occur during transport of the window, and it is a further object of this invention to provide a window that is able to withstand the severe temperature and/or pressure changes.

It is still further an object of this invention to provide a method of making a thin-film window having the above mentioned properties.

These and other objects of the invention, as well as many of the attendant advantages thereof, will become more readily apparent when reference is made to the following description, taken in conjunction with the accompanying drawings.

DETAILED DESCRIPTION OF THE DRAWINGS

Figures 1, 2, 3:
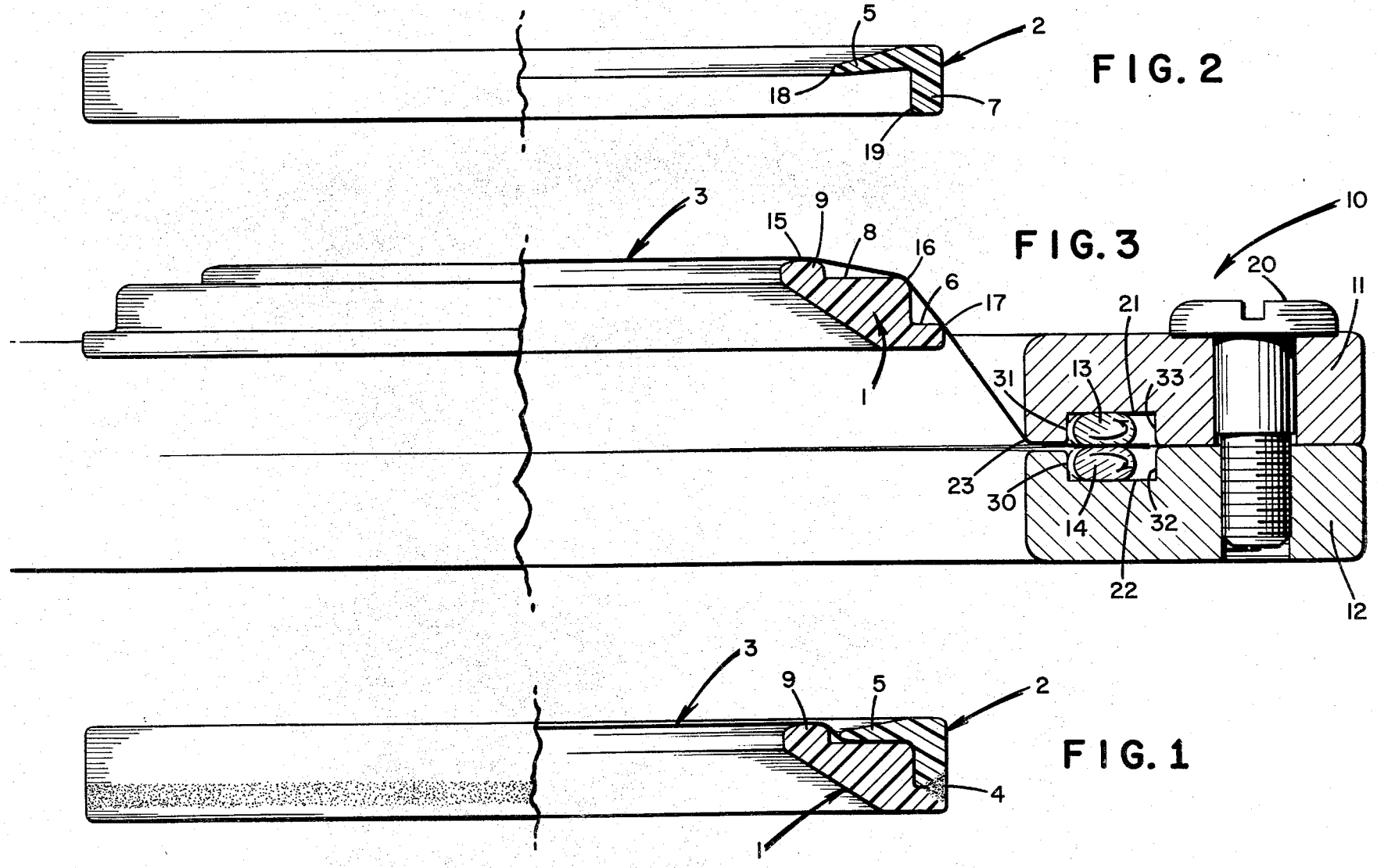
FIG. 1 shows a partial cross-sectional view of the thin-film window according to this invention.
FIG. 2 shows a partial cross-sectional view of the clamp ring.
FIG. 3 shows a partial cross-sectional view of the frame ring, thin-film, and O-ring assembly.

The invention relates to a thin-film window assembly for use in nuclear instruments. The thin-film window is constructed of three basic elements; a frame ring 1, a clamp ring 2, and a thin-film 3. The thin-film 3 is stretched over the frame ring 1, and the clamp ring 2 engages the frame ring 1 to secure the thin-film 3 to the frame ring in a tight position. The clamp ring 2 is secured to the frame ring at 4 either by welding the clamp ring to the frame ring or by glueing the clamp ring to the frame ring. The film may also be welded or glued to both the clamp ring and frame ring.

The clamp ring 2 and frame ring 1 are made of conducting plastic, preferably an air-equivalent plastic. Air-equivalent plastic is defined to be plastic having a response to photons (x-rays, $\gamma$-rays) per unit mass of material equivalent to that of air. An air equivalent plastic found useful is Type C-552 Air Equivalent Plastic supplied by Physical Sciences Laboratory, and is composed of 78.4% Polyvinylidene flouride (KYNAR), 20.75% Carbon (VULCAN X-C72), and 0.85% Silica (CABOSIL). To manufacture the clamp ring and frame ring, rods are cut from a molded block of air equivalent plastic. The diameter of the rods are approximately equal to the outside diameter of the frame ring and clamp ring. The rods are then properly stabilized by annealing the rods for approximately 24 hours at approximately 120° C., refrigerating the rods at −20° C. for approximately 4 hours, again annealing the rods for 24 hours at 120° C., and then letting the rods maintain room temperature. Thereafter, the rods are machined to form the frame ring 1 and clamp ring 2.

After the frame ring 1 and clamp ring 2 is machined, the rings must be thoroughly cleaned to remove particles and impurities that may have arisen during the machining operation. Many cleaning methods are known and can be effectively used. For example, the rings can be cleaned by immersion in an ultrasonic freon bath.

The frame ring 1 and clamp ring 2 should also be free of any internal stresses. Such stresses can be removed by subjecting the rings to alternate heating and freezing cycles. For example, it has been found effective to remove stresses by annealing the rings for 8 hours at 80° C., freezing the rings at −20° C. for 1 hour, and then repeating the cycle.

As shown in the drawings, the frame ring 1 and clamp ring 2 are annular rings of circular inner and outer diameters. Circular rings are preferred in order that the thin-film 3 can be uniformly stretched in all directions, as will be described hereinbelow. Both the frame ring 1 and clamp ring 2 should have smooth surfaces at those points which contact the thin-film, and should not have any sharp edges at such points of contact. Thus, the frame ring 1 should be smooth at points 15, 16, and 17, and the clamp ring 2 should be smooth at points 18 and 19.

The clamp ring 2 is adapted to matingly engage the frame ring 1 so as to secure the thin-film 3 therebetween. Referring to FIG. 2, the clamp ring 2 is shown as having an L-shaped cross-section with a thin inner lip 5 which is biassed slightly downward. This inner lip 5 acts as a spring so that when the clamp ring 2 is engaging the thin-film 3 and frame ring 1, the inner lip 5 provides a tension on the thin-film to keep the thin-film taut about the inner diameter of the frame ring 1.

The frame ring 1 is designed to receive the clamp ring 2 in a mating engagement. The outside periphery of the frame ring 1 includes a notch 6 which is so designed to accommodate the leg 7 of the clamp ring 2. A further notch 8 is designed to accommodate the thin inner lip 5 of the clamp ring 2 when the clamp ring 2 engages the frame ring 1. At the inner periphery of the frame ring 1 is a slightly raised protrusion 9 upon which the thin-film 3 is adapted to rest. When fully assembled, the thin inner lip 5 of the clamp ring 2 acts as a spring and exerts tension on the thin-film 3 in conjunction with the protrusion 9.

The thin-film 3 is preferably made of polyester, although other materials that would produce the desired results could be used. For example, the thin-film 3 can be made of Dupont MYLAR (polyethylene terephthalate) film. The film thickness can be 0.00014" or 3.6 μm, nominal thickness.

The clamp ring is secured to the frame ring at 4 by any well known conventional securing means. These can include welding or glueing.

The invention also relates to a method for manufacturing the thin-film window. The frame ring 1 and clamp ring 2 are machined to the required dimensions from a suitable material which has been properly stablized as discussed above. All surfaces that can come in contact with the thin-film 3, such as points 15–19 are smooth. Following the machining, the frame ring and clamp ring are cleaned, and internal stresses removed, as discussed above.

Prior to assembly, the frame ring 1 is cooled to a temperature below that of the clamp ring 2, the latter of which is maintained at room temperature, or at an elevated temperature depending upon the materials used. The frame ring should be cooled to a point so that it remains cool during the remainder of the assembly process. The purpose of the cooling step is to contract the frame ring 1, so that when it thereafter reaches room temperature, it expands to form a tight fit with the clamp ring 2. It has been found effective to cool the frame ring 1 to be a temperature of approximately 0° C.

Following the cooling step, the thin-film 3 is stretched across the frame ring 1, as shown in FIG. 3. A method of stretching the thin-film across the frame ring will be described more fully below. Following the stretching step, the clamp ring 2 is clamped over the thin-film 3 and frame ring 1 so that the film is tightly held between the rings. The clamp ring 2 and frame ring 1 are then allowed to maintain the same temperature. After the same temperature is maintained, the excess film along the outside edges of the clamp ring and frame ring is removed by cutting. The pressure between the clamp ring, and frame ring is maintained until the clamp ring is permanently secured to the frame ring by either welding, glueing, or any other well known securing means.

The thin-film is stretched over the frame ring by the following technique. Referring to FIG. 3, the thin-film 3 is prestretched in a window film stretcher 10. The window film stretcher comprises an upper and lower ring, 11 and 12, having an inner diameter greater than the outside diameter of the frame ring 1. Associated with the upper and lower rings 11 and 12 respectively are O-ring gaskets, 13 and 14 in annular notches 21 and 22. The cross-sectional widths of the notches 21 and 22 are wider than the cross-sectional diameter of the O-ring gaskets 13 and 14. That is, referring to FIG. 3, the distance between notch face 31 and 33 and notch face 30 and 32 is greater than the diameter of the O-ring gaskets 13 and 14. Further, the O-ring gaskets 13 and 14 are designed to contact the inner notch faces 31 and 30 respectively. A bolt 20 secures the upper ring 11 to the lower ring 12.

In operation, the lower ring 12 with its O-ring gasket 14 is positioned, and the thin-film is placed over the lower ring 12 and O-ring gasket 14. The upper ring 11, with its O-ring gasket 13 is placed in mating arrangement to the lower ring 12, and the bolt 20, or series of bolts, is screwed so as to compress the two O-ring gaskets, 13 and 14. During compression of the O-ring gaskets, the gaskets move away from the front notch faces 30 and 31 and rotate in a direction as shown by the arrows in FIG. 3. This movement of the O-ring gaskets results in a stretching and securing of the thin-film 3 uniformly throughout the window film stretcher 10.

Following this pre-stretching, the frame ring 1 and film stretcher 10 are moved relative to each other to stretch the thin-film 3 across the frame ring 1. This can be accomplished by keeping the frame ring 1 stationary and moving the film stretcher 10 thereover, or alternatively, by keeping the film stretcher 10 stationary and moving the frame ring 1 within the annular space of the window stretcher 10. After stretching, the clamp ring 2 then is engaged to the stretched thin-film 3 and frame ring 1.

It should be appreciated that the assembly comprising the window film stretcher 10 can itself be used as a window if the parallel plate ionization chamber is large enough to accomodate the assembly 10. In such cases, the elasticity of the window film 3 must be low so that it can be maintained tightly stretched.

The figures described herein represent a preferred embodiment of the invention, however other embodiments and numerous modifications are well within the scope of the present invention. These other embodiments and modifications will be apparent to those of ordinary skill in the art.

What is claimed is:

1. A thin-film window for a nuclear instrument comprising:

a frame ring having a surface which defines a first plane;

a thin film tightly stretched about said frame ring, said tightly stretched film defining a second plane substantially parallel to said first plane;

a clamp ring having a thin lip for securing said thin film about said frame ring in a tightly stretched condition, said thin lip acting as a spring to exert tension on said thin film in conjunction with said surface of said frame ring when said clamp ring is secured to said frame ring; and securing means for securing said clamp ring to said frame ring in an area remote from said surface of said frame ring and remote from said thin lip of said clamp ring, wherein said thin lip, acting as a spring, takes up any slack between said clamp ring and said surface of said frame ring when at least one of said frame ring and clamp ring contracts in response to temperature changes so that said thin film remains fixed between said thin lip and said surface of said frame ring.

2. A thin-film window for a nuclear instrument comprising:

a frame ring having a surface which defines a first plane;

a thin film tightly stretched about said frame ring, said tightly stretched film defining a second plane substantially parallel to said first plane;

a clamp ring having a thin lip for securing said thin film about said frame ring in a tightly stretched condition, said thin lip being adapted to return substantially to its original shape when released after being distorted, and being biassed against said surface of said frame ring in a distorted condition with said thin film interposed therebetween when said clamp ring is secured to said frame ring; and securing means for securing said clamp ring to said frame ring in an area remote from said surface of said frame ring and remote from said thin lip of said clamp ring, wherein said surface of said frame ring distorts said thin lip, said thin lip responding to said distortion by trying to recover substantially its original shape to provide a tension on said thin film in conjunction with said frame ring and wherein said thin lip takes up any slack between said clamp ring and said surface of said frame ring when at least one of said frame ring and clamp ring contracts in response to temperature changes so that said thin film remains fixed between said thin lip and said surface of said frame ring.

3. The thin-film window of claim 2 wherein said thin film has a thickness of 3.6 micrometers.

4. The thin-film window of claim 2 wherein said securing means comprises glue.

5. The thin-film window of claim 2 wherein said securing means comprises a weld.

6. A thin-film window for a nuclear instrument comprising a frame ring of air-equivalent plastic material, a thin film of polyester material tightly stretched about said frame ring, clamp ring means for securing said thin film about said frame ring in a tightly stretched condition, and securing means for securing said clamp ring means to said frame ring wherein said clamp ring means comprises a clamp ring of air-equivalent plastic material, said clamp ring being circular and annular and having a substantially L-shaped cross-section, one leg of said L-shape defining a thin lip extending radially and inwardly toward the center of said clamp ring and biassed in a direction toward the other leg of said L-shaped cross-section, said thin lip adapted to return to its original shape when released after being distorted, said frame ring comprising a circular and annular ring having an annular notch about its outer circumference and defining a first surface, a second notch substantially perpendicular to said annular notch defining a second surface, said second surface substantially perpendicular to said first surface and extending from said annular notch toward the inner circumference of said annular ring, and a protrusion about the inner circumference of said annular ring, said thin film stretched over said frame ring and in engagement with said protrusion and said first and second surfaces, said clamp ring positioned over said thin film and said frame ring wherein said thin lip of said clamp ring engages said thin film and said thin lip is distorted by said second surface, said thin lip responding to said distortion by trying to recover its original shape to provide constant tension on said thin film in conjunction with said second surface, said securing means securing said clamp ring to said frame ring in an area remote from said second surface of said frame ring and remote from said thin lip of said clamp ring, wherein said thin lip takes up any slack between said clamp ring and said surface of said frame ring when at least one of said frame ring and said clamp ring contracts in response to temperature changes so that said thin film remains fixed between said thin lip and said surface of said frame ring.

* * * * *